US010029349B2

(12) United States Patent
Christen et al.

(10) Patent No.: US 10,029,349 B2
(45) Date of Patent: Jul. 24, 2018

(54) RETAINING BODY FOR FLEXIBLE GRINDING MEANS, GRINDING SYSTEM AND GRINDING TOOL

(75) Inventors: Stefan Christen, Schneisingen (CH); Juerg Schnyder, Nuerensdorf (CH); Thomas Mathys, Lyss (CH)

(73) Assignee: Robert Bosch GmbH, Stuttgart (DE)

( * ) Notice: Subject to any disclaimer, the term of this patent is extended or adjusted under 35 U.S.C. 154(b) by 1162 days.

(21) Appl. No.: 14/345,444

(22) PCT Filed: Jul. 30, 2012

(86) PCT No.: PCT/EP2012/064874
§ 371 (c)(1),
(2), (4) Date: Oct. 2, 2014

(87) PCT Pub. No.: WO2013/041277
PCT Pub. Date: Mar. 28, 2013

(65) Prior Publication Data

US 2015/0056898 A1 Feb. 26, 2015

(30) Foreign Application Priority Data

Sep. 20, 2011 (DE) ..... 10 2011 083 032

(51) Int. Cl.
*B02C 23/18* (2006.01)
*B24D 9/08* (2006.01)
(Continued)

(52) U.S. Cl.
CPC ..... *B24D 9/08* (2013.01); *B24B 55/10* (2013.01); *B24D 9/085* (2013.01); *B24D 9/10* (2013.01)

(58) Field of Classification Search
USPC ..... 451/359, 488, 456, 548
See application file for complete search history.

(56) References Cited

U.S. PATENT DOCUMENTS 1,765,808 A 6/1930 Tone
3,395,417 A * 8/1968 Matouka ..... B24D 9/08 15/230
(Continued)

FOREIGN PATENT DOCUMENTS

CN 1803397 A 7/2006
DE 20 2009 000 880 U1 8/2009
(Continued)

OTHER PUBLICATIONS

International Search Report corresponding to PCT Application No. PCT/EP2012/064874, dated Nov. 30, 2012 and (German English language document) (5 pages).

*Primary Examiner* — Joseph J Hail
*Assistant Examiner* — Shantese McDonald
(74) *Attorney, Agent, or Firm* — Maginot, Moore & Beck LLP

(57) ABSTRACT

A retaining body for a grinding structure, in particular a grinding wheel, includes a fixing layer with a fixing surface. The fixing surface has a fixing structure configured to fix a flexible grinding structure, and includes a support body with a support surface. The support surface supports a fixing layer retaining surface that lies opposite the fixing surface, and is connected to the retaining surface. The support body is air- and dust-permeable, and includes an air- and dust-permeable material. The fixing layer is configured such that the fixing surface is substantially air- and dust-permeable in a direction that runs substantially perpendicular to the fixing surface, and such that an air flow can pass from the fixing surface through the fixing layer in a substantially perpendicular manner relative to the fixing surface.

16 Claims, 4 Drawing Sheets

(51) Int. Cl.
*B24B 55/10* (2006.01)
*B24D 9/10* (2006.01)

(56) References Cited

U.S. PATENT DOCUMENTS

| | | | | | |
|---|---|---|---|---|---|
| 6,361,424 | B1 * | 3/2002 | Manor | B24B 55/102 | 451/353 |
| 7,048,620 | B1 * | 5/2006 | Riley | B24D 9/08 | 451/353 |
| 7,458,884 | B2 * | 12/2008 | Falk | B24B 55/102 | 451/359 |
| 2007/0287366 | A1 * | 12/2007 | Sanders | B24B 23/005 | 451/526 |
| 2013/0210325 | A1 * | 8/2013 | Schnyder | B24B 55/102 | 451/488 |

FOREIGN PATENT DOCUMENTS

| | | | | | |
|---|---|---|---|---|---|
| DE | 10 2010 002 539 | A1 | | 9/2011 | |
| EP | 0 781 629 | A1 | | 7/1997 | |
| EP | 1 977 858 | A1 | | 10/2008 | |
| EP | 2 070 651 | A1 | | 6/2009 | |
| WO | 2007/143400 | A2 | | 12/2007 | |
| WO | WO 2007/143400 | | * | 12/2007 | B02C 23/18 |
| WO | 2009/088772 | A2 | | 7/2009 | |

* cited by examiner

RETAINING BODY FOR FLEXIBLE GRINDING MEANS, GRINDING SYSTEM AND GRINDING TOOL

This application is a 35 U.S.C. § 371 National Stage Application of PCT/EP2012/064874, filed on Jul. 30, 2012, which claims the benefit of priority to Serial No. DE 10 2011 083 032.4, filed on Sep. 20, 2011 in Germany, the disclosures of which are incorporated herein by reference in their entirety.

BACKGROUND

The disclosure relates to a retaining body for a flexible grinding means, a grinding system and a grinding tool, in particular a hand grinder, according to the preamble of the independent claims.

Retaining bodies of the generic type, in the form of grinding disks, are described, for instance, in DE 20 2009 000 880 and EP 0 781 629 A1. These grinding disks have a soft support body, which can comprise foam, for instance, as well as a Velcro or adhesive layer for connection to a flexible grinding means. The flexible grinding means can be, for instance, a grinding wheel. These known grinding disks have a plurality of axially running bores, through which air, and grinding dust generated during the grinding, can be extracted. These bores penetrate both the soft layer and the Velcro or adhesive layer.

Due to the necessary bores, a characteristic hole pattern, to which the grinding means usable herewith must be adapted, is obtained for the respective grinding disk. These grinding means must namely themselves have holes with a corresponding hole pattern. This is particularly disadvantageous, since, with a predefined grinding disk, only quite specific grinding means can be used. Moreover, when fastening the grinding means to the grinding disk, regard must be paid to the relative alignment of the grinding means to the grinding disk in order that the holes in the grinding means are congruent with the holes in the grinding disk and thus an extraction is possible. Constructively complex solutions to this problem are known, for example, from EP 1 977 858 or WO 2009/088772 A2.

SUMMARY

The retaining body according to the disclosure, having the features of claim 1, has the advantage that a grinding dust generated during the working process can pass initially substantially without hindrance through a suction air stream and by the shortest route through the fastening layer, since the fastening surface of the fastening layer is substantially air and dust permeable in a direction running substantially perpendicular to the fastening surface. By an "air and dust permeable fastening layer" is here understood, in particular, a fastening layer consisting at least partially of an air and dust permeable, in particular open-pore material, and/or at least partially of a material which has been made air and dust permeable by at least one machining step, for instance punching, milling and/or drilling, in particular by laser drilling or some other method comprising bores and/or ducts which pierce the material. Thus an air flow, in particular a dust-containing air flow, can pass from the fastening surface, substantially perpendicular to the fastening surface, through the fastening layer. A counterpressure on the part of the fastening layer is thereby advantageously reduced. At the same time, dust particles make their way by the shortest route from that side of the fastening layer which is facing toward a grinding process onto that side of the fastening layer which is facing away from the grinding surface.

As a result of the measures cited in the subclaims, advantageous refinements and improvements of the features defined in the principal claim are obtained.

If an air flow running substantially perpendicular to the fastening surface, in particular a dust-containing air flow, after having passed through the fastening layer, undergoes at least a partial diversion into a crossflow through the support body, which crossflow runs, from the perspective of the grinding means, substantially behind the fastening layer, a uniform removal of the grinding dust can easily be obtained without having to overcome strong restriction of the suction air stream. This is of importance, in particular, for applications in which the fastening surface of the retaining body is significantly larger than a cross-sectional area of a region on the extraction side. Thus retaining bodies according to the disclosure can preferably be of frustoconical configuration, wherein, in particular, the larger of the base areas is configured as a fastening surface.

In a preferred embodiment, the fastening means of the retaining body according to the disclosure are configured as mechanical fastening means for fastening of a flexible grinding means, in particular as loops and/or hooks protruding from the fastening surface.

In a particularly preferred embodiment, the fastening layer contains an open-pore material. The fastening layer can here, however, also consist of the open-pore material. As "open-pore" is here understood, in particular, a material which along at least one spatial direction, in particular perpendicular to the fastening surface, has pores, ducts, openings and/or recesses, so that an air stream laden with dust can pass through the material. Typically, the grinding dust which is generated in a grinding process has a typical size distribution of the grinding particles, so that preferably the minimum flow areas of the ducts, openings and/or recesses and a porosity of the pores are defined by the largest particles which typically arise during grinding.

With a textile material, the configuration as an open-pore material can be obtained in a particularly simple and cost-effective manner. The fastening layer of a particularly preferred embodiment of the retaining body according to the disclosure therefore contains, or consists of, a textile material. Preferably, the textile material has loops and/or hooks and/or mushroom heads as fastening means, which are suitable, in particular, for the formation of a known material structure. It is also conceivable, however, for a material which is dense in terms of its material structure and, in particular, is impermeable to dust and air, to advantageously be used according to the disclosure as a fastening layer by virtue of suitable perforation, perforations and/or punch holes in regular or irregular patterns. A suitable perforation, perforations and/or punch holes in regular or irregular patterns can also advantageously be combined with textile materials or material mixtures.

A preferred development of the retaining body according to the disclosure is achieved if the fastening layer almost fully, preferably fully covers the fastening surface.

A particularly effective embodiment of a retaining body according to the disclosure is achieved by virtue of the fact that the support body has a dust chamber, which is preferably provided in a region adjacent to the support surface, wherein the dust chamber, from the perspective of the support surface, has a honeycombed structurization, which is permeated by ducts, channels and/or grooves for guidance of an air flow. In particular, a dust chamber of this type causes a pressure barrier which might build up and impede the dust-containing air stream following passage through the fastening layer according to the disclosure to be advantageously reduced. This is of importance, in particular, for applications in which the fastening surface of the retaining body is significantly larger than a cross-sectional area of a region on the extraction side, since, particularly in applications of this type, an increasing constriction of a lateral extent of the air stream as it flows through the support body could produce a throttling effect. The dust chamber enables the diversion of the air stream here to be realized with least possible losses. Alternatively or additionally, at least one dust chamber can also be provided inside the support body, which dust chamber has similar effects. Preferably, the diversion of the air flow therefore takes place substantially in the dust chamber.

If the support body of the retaining body according to the disclosure has at least one outlet air bore, which in an air and dust permeable manner connects the dust chamber to a surface lying opposite the support surface and through which air can be extracted from the dust chamber, then the retaining body according to the disclosure can be applied particularly easily to a grinding machine with extraction device, whether it be an internal or else an external provided extraction unit.

In one development, the support body has at least one inlet air bore, via which an air stream can be conducted into a region in front of the fastening layer of the retaining body. In a particularly preferred embodiment, the inlet air bore here introduces fresh air into a central region of the retaining body, from where the fresh air is fed to a machining region.

In a particularly preferred embodiment, the honeycombed structure of the dust chamber is formed substantially by supporting projections which protrude from the rest of the support body and which jut at least partially into the support surface, so that those parts of the supporting projections which jut into the support surfaces form parts of the support surface, wherein the fastening layer is preferably connected, in particular bonded and/or welded, to these parts of the support surfaces. As a result, the loads, in the specific application, are more evenly distributed onto the joint of the fastening layer on the retaining body. At the same time, the fastening layer is more evenly supported on the support surface, so that the machining forces can be transmitted such that they are more evenly distributed over the surface.

A further advantageous development of the retaining body according to the disclosure provides that the support body has a connection surface lying substantially opposite the support surface, wherein the connection surface has a smaller surface area, in particular a smaller outer diameter, than the support surface, and wherein preferably at least one extraction opening is provided in the connection surface.

If the support body has at least a supporting element and a cover plate, wherein the supporting element extends between the support surface and the cover plate and is air and dust permeable, in particular consists of an air and dust permeable material, and wherein the cover plate substantially forms the connection surface, the support body can advantageously be protected from mechanical damage. Furthermore, the cover plate enables the integration of a robust interface for the connection of the retaining body according to the disclosure to a grinding machine. The interface can here be configured, in particular, as a screw, latching, clip-on and/or plug connection. However, further embodiments of tool interfaces, such as, for instance, for rotary oscillating tools, which embodiments can here advantageously be provided in or on the cover plate, are also known to the person skilled in the art.

In an alternative or supplementary development, it can be provided that the support body has a protective element, preferably is radially enclosed by the latter, wherein a radial outer contour, facing toward the support surface, substantially resembles an outer contour of the support surface, preferably is almost identical thereto. The protective element advantageously protects the support body from mechanical damage with respect to its peripheral surface. Furthermore, the protective element can be provided to configure a support body such that it is air and dust tight in terms of its peripheral surface, in particular to seal a support body, preferably a supporting element made of an open-pore material, in an air and dust tight manner in terms of its peripheral surface, so that an air stream can make its way through the retaining body only via radial end faces.

Furthermore, the protective element can have an advantageous contact surface lying in a plane of the support surface, wherein the fastening layer, at least at the contact surface, is connected, in particular bonded and/or welded, to the protective element, so that in particular the fastening layer is connected, preferably circumferentially, to the protective element. The contact surface is here preferably configured as a flat annular surface or flat ring-like surface.

In another aspect, the disclosure relates to a grinding means, in particular a flexible grinding means as claimed in claim 16. The grinding means according to the disclosure comprises a working layer, substantially covering a working surface, an air and dust permeable substrate, and a connecting layer having connecting means which cooperate with the fastening means of the retaining body for fastening of the grinding means to the retaining body, which connecting layer provides a connecting surface substantially facing away from the working surface and is configured such that the connecting surface, in a direction running substantially perpendicular to the connecting surface, is substantially air and dust permeable. By a "flexible grinding means" is here understood, in particular, a grinding wheel, which, in a loose state not connected to the retaining body, can be bent, buckled or otherwise deformed, at least in a direction perpendicular to the working surface. By a "working layer" is here understood, in particular, a layer having at least one abrasively acting medium, such as, for instance, abrasive grains of known abrasives having a given abrasive grain distribution. The substrate can here have an open-pore, in particular air and dust permeable paper, textile, foam and/or elastomer component, in particular can consist thereof. The connecting layer can preferably comprise a textile and/or otherwise open-pore material, in particular can consist thereof, which material has connecting means suitable for connection to the fastening means of the retaining body according to the disclosure.

In a further aspect, the disclosure relates to a grinding system comprising a retaining body according to the disclosure and at least one grinding means, which latter can be fastened to the fastening surface of the retaining body. The grinding means is here preferably at least partially air and dust permeable in design. Thus perforations, in particular breaches or apertures, can be provided, for instance, in the grinding means, which perforations are arranged distributed over the working surface of the grinding means.

Finally, in a further aspect, the disclosure relates to a grinding machine, in particular a hand grinder, comprising at least one retaining body according to the disclosure and a drive unit for driving the at least one retaining body. A preferred grinding machine additionally has an extraction device, which provides a suction air stream flowing from the fastening surface, via the retaining body according to the disclosure, in the direction of the extraction device. The extraction device can here be configured as a pipe system for the connection of an external extraction unit and/or as an extraction device actively driven by the drive unit of the grinding machine.

BRIEF DESCRIPTION OF THE DRAWINGS

Illustrative embodiments of the disclosure are represented in the drawings and explained in detail in the following description, wherein.

DETAILED DESCRIPTION

Figure 1:
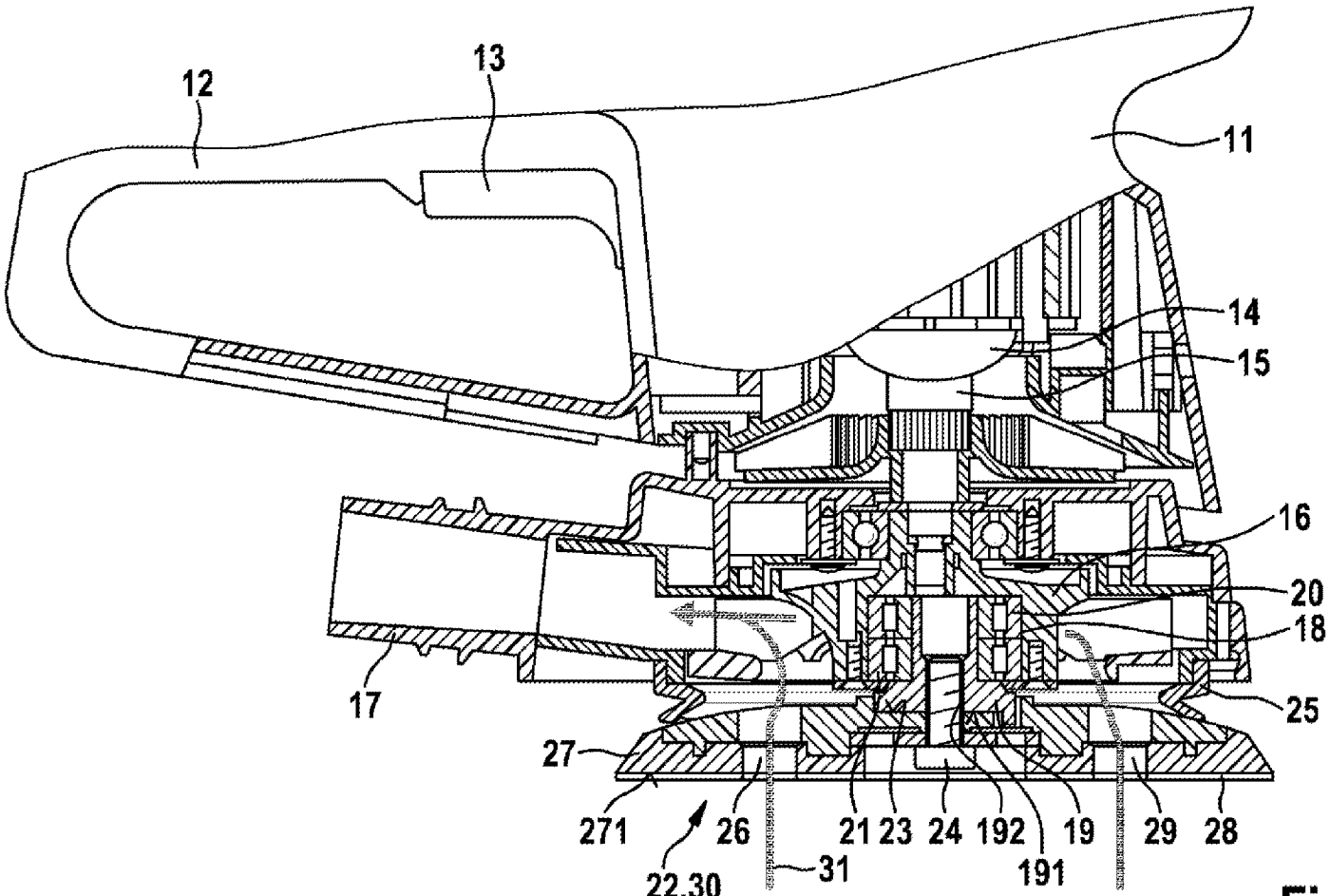
FIG. 1 shows a partial view of a grinding machine having a retaining body according to the prior art.

In FIG. 1, a hand-guided eccentric grinding machine, hereinafter referred to, in brief, as an eccentric grinder, is represented selectively and partially sectioned in side view as an example of a grinding machine having a retaining body according to the prior art. The eccentric grinder has a housing 11, which, to the left in the direction of view, merges into a handle 12, on the bottom side of which is arranged a switch button 13 for switching on and off an electric motor 14, accommodated inside the housing 11, of the drive unit. Seated in a rotationally secure manner on the output shaft 15 of the electric motor 14 is an impeller 16 of a suction fan, with which the grinding dust that during grinding jobs accrues on the surface of a workpiece and is transported via a blow-out connecting branch 17 into a dust collecting container. In the hub of the impeller 16 is provided an eccentric recess 18, into which intrudes a driver 19, which protrudes on the bottom side of the housing 11 and is supported against the inner wall of the eccentric recess 18 by two roller bearings 20, 21. The driver 19 is rotationally transported by means of the roller bearings 20, 21. The roller bearings 20, 21 and the driver 19 are held in the eccentric recess 18 such that they are axially non-displaceable.

On the bottom side of the driver 19 is configured a supporting surface 191, to which a retaining body 30 according to the prior art, configured as a grinding disk 22, can be attached with a contact surface 23 configured on its top side. The connection between grinding disk 22 and driver 19 is effected by at least one cap screw 24, which can be screwed into at least one axial bore 192 configured in the driver 19. To the bottom side of the housing 11 is fastened in a twist-protected manner a rubber disk brake 25, which comes to bear onto the top side of the grinding disk 22.

The grinding disk 22 consists of two components, a base plate 26, made of a hard plastic, and a abrasive pad 27, fastened to the bottom side of the base plate 26. The contact surface 23 of the grinding disk 22 is configured centrically on the base plate 26. On the bottom side, facing away from the base plate 26, of the abrasive pad 27 is configured a supporting surface 271 for an abrasive sheet (not represented here), which supporting surface, for the fastening of the abrasive sheet carrying a velour back, bears a Velcro lining 28. When self-adhesive abrasive paper is used, the Velcro lining is dispensed with. In the grinding disk 22, dust extraction openings 29, which extend through the base plate 26 and the abrasive pad 27, are present, via which the grinding dust is sucked by means of a suction air stream 31 into a dust intake chamber which is configured in the housing 11 and is connected to the blow-out connecting branch 17 and in which the impeller revolves. In the abrasive sheet according to the prior art (not represented here), for the extraction of the grinding dust accruing in the course of a machining operation, apertures, in particular bores, which, in the attachment of the abrasive sheet, for an optimal extraction effect, must be brought into line with the dust extraction openings 29, are provided. For simplification of the attachment process, it is known, inter alia, to make the dust extraction openings 29 larger than the apertures in the abrasive sheet, so that an overlap can be more easily achieved. Abrasive sheets which have a number of apertures, in particular a multiplicity thereof, in excess of the number of dust extraction openings 29 are also known, so that an overlap is more easily achievable.

Figure 2:
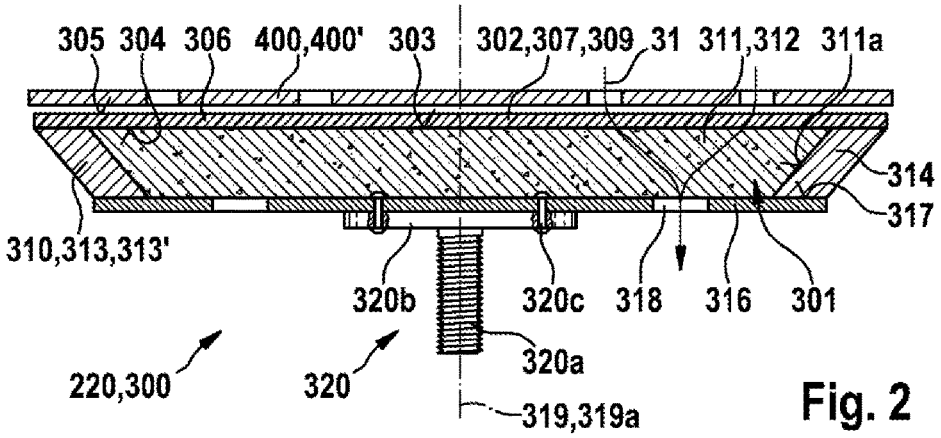
FIG. 2 shows a schematic sectional view of a first illustrative embodiment of a retaining body according to the disclosure.

FIG. 2 shows as a first preferred illustrative embodiment a retaining body 300 according to the disclosure, configured as a grinding disk 220. The retaining disk 300 is here preferably configured substantially in the shape of a circular disk.

The retaining body 300 according to the disclosure comprises a preferably substantially circular-disk-shaped support body 301 and a fastening layer 302, which latter is disposed on a substantially flat, preferably flat support surface 303 of the support body 301. The fastening layer 302 is here connected to the support body 301 with a retaining surface 304, which is arranged lying preferably substantially opposite the support surface 303. To this end, the fastening layer 302 can be bonded, welded, clamped, wedged, snap-fitted, and/or otherwise integrally and/or positively connected, with its retaining surface 304, preferably at least partially and/or in portions, to the support surface 303 of the support body 301. The retaining surface 304 here lies preferably opposite a fastening surface 305 of the fastening layer 302, which has fastening means 306 for fastening of a flexible grinding means 400. Preferably, the fastening means 306 are designed such that, for the establishment of a detachable connection of the flexible grinding means 400 on the retaining body 300, they can cooperate with connecting means (not represented here) of the flexible grinding means 400.

In a preferred embodiment according to FIG. 2, the fastening layer 302 consists at least partially, preferably, however, almost fully, of an air and dust permeable material 307, so that the fastening layer 302, in particular in a direction 308 running substantially perpendicular to the fastening surface 305, is substantially air and dust permeable. In a particularly preferred embodiment, the fastening layer 302 here consists of an air and dust permeable—preferably textile—Velcro material 309.

In the preferred embodiment according to FIG. 2, the support body 301 consists of a protective element 310 and a supporting element 311. At least the supporting element 311 is here of air and dust permeable configuration, preferably the supporting element 311 consists at least partially, preferably almost fully, of an air and dust permeable material 312. The air and dust permeable material 312 can here be, in particular, a foam or another open-pore material.

In the preferred embodiment according to FIG. 2, the protective element 310 here preferably surrounds the supporting element 311 substantially annularly, wherein by "annularly enclose" is understood, in particular, that the supporting element 311, along its perimeter or its envelope surface 311*a*, is almost fully, preferably fully encompassed or enclosed—in particular radially—by the protective element 310. A radial outer contour, facing toward the support surface 303, of the protective element 310 here preferably substantially resembles an outer contour of the support surface 303, preferably is almost identical thereto.

Preferably, the protective element 310 consists of a material 313 which is more air-tight and more dust-tight compared to the air and dust permeable material 312, particularly preferably of an air and dust tight material 313'. The material 313, 313' is here preferably stronger, in particular stiffer, than the material 312, whereby the air and dust permeable material 312 of the supporting element 311 can be better protected against mechanical damage when the retaining body 300 according to FIG. 2 is used.

The protective element 310 further has a contact surface 314, which lies substantially in a plane of the support surface 303. Preferably, the fastening layer 302 is here connected, in particular bonded and/or welded, at least at or on the contact surface 314, to the protective element 310. In the preferred embodiment according to FIG. 2, the retaining surface 304 of the fastening layer 302 is here connected, in particular bonded and/or welded, at least almost fully, preferably fully, to the contact surface 314.

According to FIG. 2, a preferred connection surface 315 of the support body 301, which connection surface lies opposite the support surface 303 of the support body 301, has a smaller surface area, in particular a smaller outer diameter, compared to the support surface 303. The connection surface 315 is here almost fully, preferably fully covered by a cover plate 316. In particular, the cover plate 315 reaches radially up to a second contact surface 317, lying substantially opposite the contact surface 314, of the protective element 310, wherein the cover plate 316 radially covers the contact surface 317 at least partially, preferably almost fully. Preferably, the cover plate 316 is connected, in particular bonded and/or welded, in the region of this coverage to the protective element 310.

As a result of the connection of the cover plate 316 to the protective element 310, in particular an advantageous guidance of a suction air stream 31 through the retaining body 31 according to the disclosure can be achieved. To this end, the cover plate 316 according to FIG. 2 has at least two, preferably radially equidistant outlet air bores 318, which when the retaining body 300 according to the disclosure is operated on a suitable grinding machine—allow a passage of the suction air stream 31 through the cover plate 316 substantially in the axial direction, i.e. substantially parallel to the direction 308. By "radially equidistant" is here understood, in particular, that the outlet air bores 318 are arranged at almost equal, preferably equal radial distance around a center of movement 319 for instance a rotational axis 319*a*—of the retaining body 300 according to the disclosure. It can also be advantageous, however, for just one, or even three, four or more outlet air bores 318 to be provided. In particular, it can also be of advantage if the outlet air bore 318 are not distributed at a radially equal distance apart over the cover plate 316.

A preferred cover plate 316 here consists of a harder, more robust material than the support body 301 and, in particular, the supporting element 311, wherein the cover plate 316 here preferably consists of a plastic, such as, for instance, of at least one, thermosetting plastic, thermoplastic and/or fiber reinforced plastic, and/or a metal, in particular a light metal or a light metal alloy.

On the preferred cover plate 316 of the illustrative embodiment according to FIG. 2 there is further arranged a fastening device 320, via which the retaining body 300 according to the disclosure can be connected to a grinding machine (not shown here). In this example, the fastening device 320 comprises a threaded pin 320*a* and a retaining plate 320*b*, to which the threaded pin 320*a* is fixedly connected and which is itself integrally, positively or non-positively connected to the cover plate 316. In the example according to FIG. 2, the retaining plate 320*b* is connected to the cover plate 316 by rivet joints 320*c*. However, alternative or supplementary fastening methods, which can here be just as advantageously used, are also known to the person skilled in the art.

If a retaining body 300 according to the prior art, according to the example of FIG. 2, is used with a grinding machine 10 as known, inter alia, from FIG. 1 and, following attachment of a suitable grinding means 400, is set in operation, then the impeller 16 generates a suction air stream 31, which sucks air laden with grinding dust through the at least partially air and dust permeable grinding means 400 and the air-permeable and gas-permeable fastening layer 302 of the retaining body 300 according to the disclosure into the support body 301. According to the disclosure, the suction air stream 31 here runs initially substantially parallel to the direction 308, i.e. almost perpendicularly through the fastening surface 305, the fastening layer 302 and the support surface 301. After the suction air stream 31 has penetrated into the support body 301, in particular into the support body 311, the suction air stream undergoes a diversion into a transverse direction, i.e. a diversion having at least one directional component perpendicular to the direction 308. In the example according to FIG. 2, the suction air stream 31, in its path through the supporting element 311, is bunched in the direction of the outlet air bores 318 in the cover plate 316 such that the suction air stream 31 passes through the outlet air openings 318 again almost parallel to the direction 308. The suction air stream 31 now continues its already known path through the grinding machine 10. All in all, however, the suction air stream 31, in its path through the retaining body 300 according to the disclosure, undergoes a significantly gentler diversion, i.e. a diversion having larger radii of curvature than in retaining bodies 30 according to the prior art, so that the retaining body 300 according to the disclosure advantageously contributes to lower vortex formation and increased suction power. In addition, the retaining body 300 according to the disclosure allows the suction power of an extraction device to be distributed as evenly as possible over the fastening surface 305, so that the extraction of grinding dust can take place over as wide an area as possible.

Figure 3:
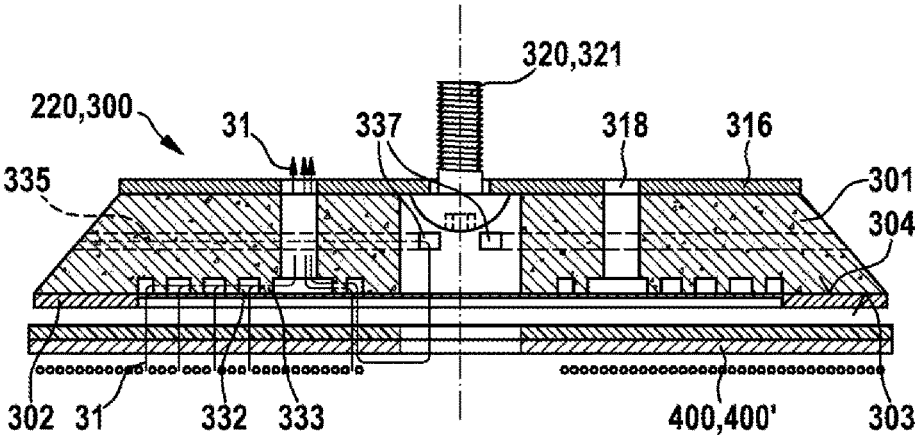
FIG. 3 shows a schematic sectional view of a second illustrative embodiment of a retaining body according to the disclosure.

FIG. 3 shows a development of a retaining body 300 according to the disclosure as already known from FIG. 2. Below, only the divergences are discussed in detail. Features which are configured to produce the same effect as the previously described example are denoted by identical reference symbols.

The retaining body 300 according to FIG. 3 comprises a support body 301 having a fastening layer 302 similar to the embodiment according to FIG. 2. The support body 301 here consists of a substantially air and dust permeable material and, for the provision of air permeability and dust permeability, has at least one, preferably two or more suction air bores 330 distributed radially over the disk-shaped cross-sectional area of the support body 301. The suction air bores 330 here connect the connection surface 315 to the region of the support surface 303. Analogously to the example according to FIG. 2, a cover plate 316, which has outlet air bores 318, is configured on the connection surface 315. If the support body 301, similarly to the first illustrative embodiment according to FIG. 2, consists at least partially of an air and dust permeable, in particular open-pore material 312, the suction air bores 330 can also be dispensed with.

Figure 4:
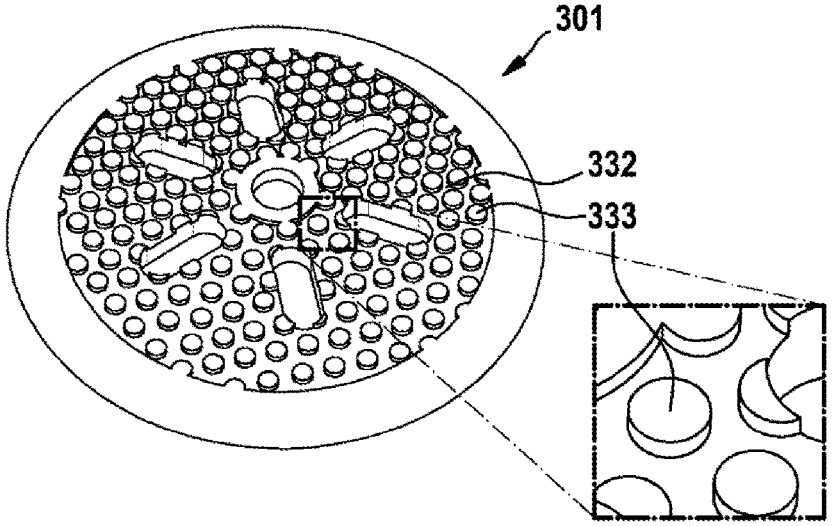
FIG. 4 shows a top view of the support surface of a retaining body according to the disclosure, in an embodiment according to FIG. 3.

The support body 301 according to FIG. 3 further has in a region 331 adjacent to the support surface 303 a dust chamber 332, into which, in particular, the suction air bores 330 emerge. The suction chamber 332 here extends preferably substantially parallel to the support surface 303. Preferably, the dust chamber 332 is here of knobbed and/or honeycombed structure. In addition, FIG. 4 shows a top view of the support surface 303 and the dust chamber 332 of a support body 301 according to the example of FIG. 3, wherein the dust chamber 332, by virtue of supporting projections 333 protruding from the rest of the support body, is of knobbed structure, said supporting projections jutting at least partially into the support surface. Those parts of the supporting projections 333 which jut into the support surface 303 here preferably form parts of the support surface 303. In this example, the dust chamber 332 here forms, as before, a coherent space.

Analogously to the knobbed supporting projections 332, the dust chamber 332, also ducts, grooves and/or wall pieces, can be segmented in a honeycombed manner, wherein interruptions in the ducts, grooves and/or wall pieces ensure that the dust chamber 332 extends substantially as an open space over a connected region of the support surface 303. It can also, however, be advantageous to divide the dust chamber 332 into individual dust chamber portions which have no cross connection one to another.

The dust chamber 332 in the support body 301 of the retaining body 300 according to FIG. 3 is covered, or closed off in an air and dust permeable manner in the direction of the support surface 303, by the fastening layer 302 according to the first embodiment. Advantageously, the fastening layer 302 is here connected, in particular bonded and/or welded, to the parts, supporting projections 333, ducts, grooves and/or wall pieces, jutting into the support surface 303.

At variance with the embodiment according to FIG. 2, the fastening device 320 is realized as a fastening screw 321, which is guided through a central bore 322 in the retaining body 300 and a through bore 323 in the cover plate 316 and with which the retaining body 300 according to the disclosure can be connected to a grinding machine 10.

If a retaining body 300 according to the example of FIG. 3 is used with a grinding machine 10 as known, inter alia, from FIG. 1 and, following attachment of a suitable grinding means 400, is set in operation, then the impeller 16 generates a suction air stream 31, which sucks air laden with grinding dust through the at least partially air and dust permeable grinding means 400 and the air and dust permeable fastening layer 302 of the retaining body 300 according to the disclosure into the dust chamber 332 of the support body 301. In the dust chamber 332, a diversion of the suction air stream 31 is effected analogously to the example according to FIG. 2, wherein, although in the embodiment according to FIG. 3, tighter radii of curvature must be observed than in the example according to FIG. 2, the open configuration of the dust chamber 332 also ensures an effective diversion of dust particles of larger dimensions through to the suction air bores, which effectively prevents blockage of the retaining body 300 according to the disclosure.

In addition, FIG. 3 shows a further development of the retaining body 300 according to the disclosure in the form of dashed drawing segments. In the support body 301 are here provided one or more fresh air lines 334, which conduct an air stream 335 via inlet air openings (not represented) out of an environment enclosing the retaining body 300, through the support body 301, into the proximity of a machining zone 336. In particular, it is provided that fresh air bores 337 emerge into the central bore 322, so that the air stream 335 can flow at least partially over a central region of the machining zone 336.

Figure 5:
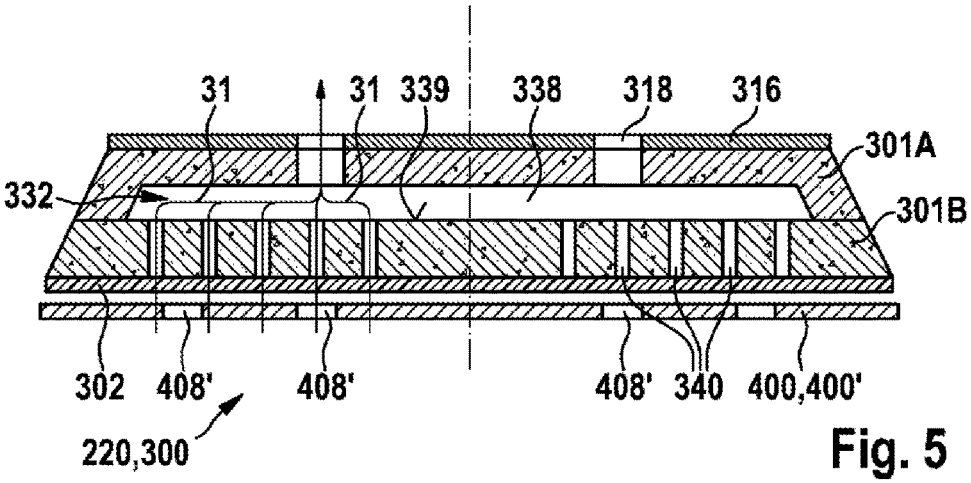
FIG. 5 shows a schematic sectional view of a second illustrative embodiment of a retaining body according to the disclosure.

FIG. 5 shows an alternative or supplementary development of a retaining body 300 according to the disclosure as already known from FIG. 2 and/or FIG. 3. Below, only the divergences are discussed in detail. Features which are configured to produce the same effect as the previously described example are denoted by identical reference symbols.

Analogously to the example from FIG. 3, the support body 301 is made of a substantially air and dust permeable material and, for the provision of air permeability and dust permeability, has at least one, preferably two or more suction air bores 330 distributed radially over the disk-shaped cross-sectional area of the support body 301.

At variance with the preceding example, the support body 301 consists, however, of at least a first support body part 301A and a second support body part 301B, wherein the at least two support body parts 301A, 301B are preferably fixedly connected to one another and thus form the support body 301. A connection of the at least two support body parts 301A, 301B can here be effected, in particular, by bonding, welding or another integral connection and/or via a positive and/or non-positive closure, such as, for example, screwing, clamping or latching engagement.

The first support body part 301A here has the connection surface 315 and on the other hand provides, via a recess 338 facing toward the second support body part 301B, an inner dust chamber 332. The dust chamber 332 is here closed off, following establishment of the connection of the second support body part 301B to the first support body part 301A by a boundary surface 339 of the second support body part 301B—in the sense of "as far as possible separated from the rest of the environment". Alternatively, the recess 338 can also be provided in the second support body part 301B, and the boundary surface 339 in the first support body part 301A. It is also conceivable for a recess 338 to be provided in each of the support body parts 301A, 301B, which recesses, following joining of the two support body parts 301A, 301B, form the dust chamber 332.

The second support body part 301B further has a multiplicity of dust air bores 340, which connect the preferably fastened air and dust permeable fastening layer 302, disposed on the support surface 303 lying opposite the boundary surface 339, in an air and dust permeable manner to the boundary surface 339.

In a retaining body 300 according to FIG. 5, the advantageous diversion and/or bunching of the suction air stream 31 takes place substantially dust chamber 332. Otherwise, the retaining body 300 according to FIG. 5 corresponds in its effect to the previously described examples, to whose description reference is made.

At variance with the preceding description of the example according to FIG. 5, it can also be provided, however, that the second support body part 301B consists wholly or partially of the air and dust permeable material 312 according to the illustrative embodiment according to FIG. 2, so that the dust air bores 340 can preferably be dispensed with, which can advantageously promote a more even areal distribution of the suction air stream 31 on the fastening surface 305.

The person skilled in the art acquires further illustrative embodiments, inter alia, by advantageous combinations of the previously described individual illustrative embodiments and developments. In particular, the combination with suitable fresh air lines and/or bores can be transferred in an obvious manner to the other illustrative embodiments by the person skilled in the art.

A particularly advantageous variant can be obtained, for instance, by a supporting element 311, as known from according to the example according to FIG. 2, consisting of a first supporting element part 311A and a second supporting element part 311B, similarly to the structure of the support body 301 according to FIG. 5, wherein, in particular, at least one, preferably both supporting element parts 311A, 311B consist of the air and dust permeable material 312. Preferably, the supporting element parts 311A, 311B are enclosed by a protective element 310 similarly to the embodiment according to FIG. 2. In addition, at least one recess 338 for the formation of a dust chamber 332, similarly to the embodiment according to FIG. 5, can preferably be provided in at least one of the supporting element parts 311A, 311B.

Figure 6A:
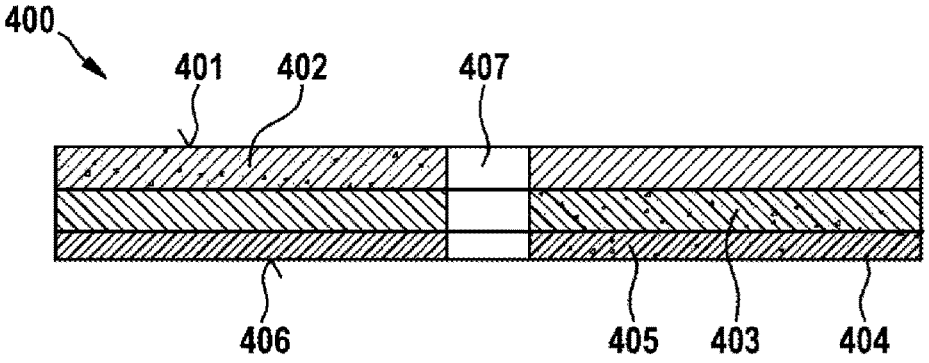
FIGS. 6*a*, 6*b* show a schematic views of a grinding means for attachment to a retaining body according to the disclosure.
Figure 6B:
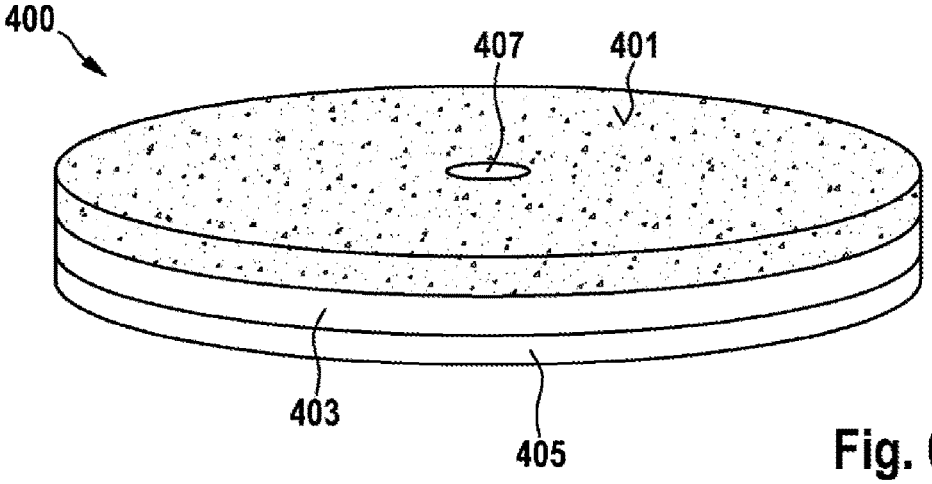

FIGS. 6*a* and 6*b* show, in addition, a grinding means 400 according to the disclosure, in particular a flexible grinding means 400, which further promotes the effect of the retaining body 300 according to the disclosure. The grinding means 400 here comprises a working layer 402, substantially covering a working surface 401, an air and dust permeable substrate 403, as well as a connecting layer 405, which has a connecting means 404 cooperating with the fastening means 306 of the retaining body 300 for fastening of the grinding means 400 to the retaining body 300. The connecting layer 405 here provides a connecting surface 406 substantially facing away from the working surface 401. Furthermore, the connecting layer 405 is configured such that the connecting surface 406, in a direction running substantially perpendicular to the connecting surface 406, is substantially air and dust permeable.

If a preferred grinding means 400 according to FIGS. 6*a*, 6*b* is attached to a retaining body 300 according to the disclosure according to one of the previously described illustrative embodiments and is set in operation in a grinding machine 10, then the impeller 16 generates a suction air stream 31, which sucks air laden with grinding dust along the direction 308 from the working surface 401, through the air and dust permeable substrate 403 into the air and dust permeable connecting layer 405, and from there into the air and dust permeable fastening layer 302 of the retaining body 300 according to the disclosure into the support body 301. According to the disclosure, the suction air stream 31 here runs initially substantially parallel to the direction 308, i.e. almost perpendicularly through the substrate 403, the joint layer of connecting layer 405 and fastening layer 302, as well as through the support surface 301. Beyond this, the suction air stream 31 follows the previously described paths, to whose description reference is made. The grinding means 400 according to FIGS. 6*a*, 6*b* further has an optional, central bore 407, which, in particular with a retaining body 300 having at least one fresh air line 334 that emerges into the central bore 322, can be of advantage. The grinding means 400 according to the disclosure can here also advantageously be used on a retaining body 30 according to the prior art, since, here too, when attaching a grinding means 400, a relative alignment in relation to the dust extraction openings 29 in the retaining body 30 can advantageously be ignored. For this, the grinding means 400 must merely have a connecting layer 405 with connecting means 404, which latter can cooperate with fastening means of the retaining body 30 such that the grinding means 400 adheres, advantageously detachably adheres, to the fastening surface of the retaining body 30.

Alternatively, an already known flexible grinding means 400', which has a plurality of extraction holes 408' distributed over the working surface 401' and piercing the grinding means 400', can also advantageously be used on a retaining body 300 according to the disclosure. When attaching a grinding means 400' of this type, an alignment of the extraction holes 408' relative to the fastening surface 305 here advantageously has no effect on extraction performance. For this, the grinding means 400' must merely have a connecting layer 405' with connecting means 404', which latter can cooperate with the fastening means 306 of the retaining body 300 according to the disclosure such that the grinding means 400' adheres, preferably detachably adheres, to the fastening surface 305.

In addition to the illustrative embodiments and application examples of a retaining body 300 according to the disclosure, which are here described in detail with reference to an eccentric grinder, a number of further grinding machines with extraction devices, which grinding machines, both with substantially circular retaining bodies 300—for instance orbital grinders and polishing machines—and with polygonal, in particular substantially triangular, rectangular or trapezoidal retaining bodies 300*a*, are known to the person skilled in the art. The person skilled in the art will therefore be able to transfer the disclosed teaching with ease to a grinding machine with polygonal, in particular substantially triangular, rectangular or trapezoidal retaining bodies 300*a*. For these retaining bodies 300*a* too, an advantageous diversion of the air flow through the retaining bodies 300*a* can be analogously obtained by simple modification of the retaining body geometry, without having to change parts, which are fundamental to the disclosure, of the described embodiments. Retaining bodies 300*a* of this type should therefore explicitly be jointly embraced by the Application.

The invention claimed is:

1. A retaining body for a grinding structure, comprising:

a fastening layer with a fastening surface, having a fastening structure configured to fasten a flexible grinding structure; and a support body with a support surface configured to support a retaining surface, wherein:

the support body is air and dust permeable;

the fastening layer is configured such that the fastening surface, in a direction running substantially perpendicular to the fastening surface, is substantially air and dust permeable, so that an air flow can pass from the fastening surface, substantially perpendicular to the fastening surface, through the fastening layer;

the support body has a recessed surface that is recessed from the support surface, the recessed surface defining a dust chamber;

the support body further includes a knobbed structurization that includes a plurality of supporting projections protruding from the recessed surface and which are separated from one another by at least one of ducts, channels and grooves configured to guide an air flow, the plurality of supporting projections including an outer surface that form at least a portion of the support surface.

2. The retaining body as claimed in claim 1, wherein:
the air flow running substantially perpendicular to the fastening surface, after having passed through the fastening layer, undergoes at least a partial diversion into a crossflow through the support body; and
the crossflow runs, from a perspective of the grinding structure, substantially behind the fastening layer.

3. The retaining body as claimed in claim 2, wherein the at least partial diversion of the air flow takes place substantially in the dust chamber.

4. The retaining body as claimed in claim 1, wherein:
the fastening structure is configured as a mechanical fastening structure for fastening of a flexible grinding structure; and
at least one of loops and hooks protrude from the fastening surface.

5. The retaining body as claimed in claim 1, wherein the fastening layer includes an open-pore material.

6. The retaining body as claimed in claim 1, wherein the fastening layer includes a textile material having at least one of loops, hooks, and mushroom heads.

7. The retaining body as claimed in claim 1, wherein the fastening layer substantially covers the fastening surface.

8. The retaining body as claimed in claim 1, wherein the support body has at least one suction air bore, which, in an air and dust permeable manner, connects the dust chamber to a surface lying opposite the support surface, and through which air can be extracted from the dust chamber.

9. The retaining body as claimed in claim 1, wherein the support body has at least one fresh air line, via which an air stream can be conducted into a region in front of the fastening layer of the retaining body.

10. The retaining body as claimed in claim 1, wherein:
the support body has a connection surface lying substantially opposite the support surface;
the connection surface has a smaller surface area than a surface area of the support surface; and
at least one extraction opening is located in the connection surface.

11. The retaining body as claimed in claim 10, wherein:
the support body has at least a supporting element and a cover plate
the supporting element extends between the support surface and the cover plate and is air and dust permeable; and
the cover plate substantially covers the connection surface or forms the connection surface.

12. The retaining body as claimed in claim 10, wherein:
the support body has a protective element; and
a radial outer contour, facing toward the support surface, of the protective element substantially resembles an outer contour of the support surface.

13. The retaining body as claimed in claim 12, wherein:
the protective element has a contact surface, which lies in a plane of the support surface; and
the fastening layer is connected, at least at the contact surface, to the protective element.

14. A grinding system comprising:
at least one retaining body for a flexible grinding structure that includes:
a fastening layer with a fastening surface having a fastening structure configured to fasten a flexible grinding structure; and
a support body with a support surface configured to support a retaining surface, wherein:
the support body is air and dust permeable;
the fastening layer is configured such that the fastening surface, in a direction running substantially perpendicular to the fastening surface, is substantially air and dust permeable; and
the support body has a recessed surface that is recessed from the support surface, the recessed surface defining a dust chamber;
the support body further includes a knobbed structurization that includes a plurality of supporting projections protruding from the recessed surface and which are separated from one another by at least one of ducts, channels and grooves configured to guide an air flow, the plurality of supporting projections including an outer surface that form at least a portion of the support surface; and
at least one at least partially air and dust permeable grinding structure configured to be fastened to the fastening surface of the retaining body.

15. The grinding system as claimed in claim 14, further comprising a drive unit configured to drive the at least one retaining body.

16. A retaining body for a grinding structure, comprising:
a fastening layer with a fastening surface, having a fastening structure configured to fasten a flexible grinding structure; and
a support body with a support surface configured to support a retaining surface, wherein:
the support body is air and dust permeable;
the fastening layer is configured such that the fastening surface, in a direction running substantially perpendicular to the fastening surface, is substantially air and dust permeable, so that an air flow can pass from the fastening surface, substantially perpendicular to the fastening surface, through the fastening layer,
the support body has a dust chamber, that, from a perspective of the support surface, has a knobbed structurization, and is permeated by at least one of ducts, channels and grooves configured to guide an air flow, and
the support body has at least one fresh air line, via which an air stream can be conducted into a region in front of the fastening layer of the retaining body.

* * * * *